US005775682A

United States Patent [19]

Hosking et al.

[11] Patent Number: 5,775,682

[45] Date of Patent: Jul. 7, 1998

[54] SHEET TRANSFER MEMBER HAVING AT LEAST ONE OUTWARDLY OPENING SHEET-RECEIVING SLOT AND SHEET WITHDRAWL PORTION AND APPARATUS INCLUDING SUCH A MEMBER

[75] Inventors: Steven Michael Hosking, Hampshire; Raymond William Simpson-Davis, Southampton, both of United Kingdom

[73] Assignee: De La Rue International Limited, United Kingdom

[21] Appl. No.: 649,366

[22] Filed: May 17, 1996

[30] Foreign Application Priority Data

May 22, 1995 [GB] United Kingdom ..... 9510297

[51] Int. Cl.[6] ..... B65H 5/22

[52] U.S. Cl. ..... 271/3.08; 271/3.12; 271/119; 271/227; 271/261; 271/315

[58] Field of Search ..... 271/3.01, 3.08, 271/3.12, 10.09, 10.11, 10.12, 109, 119, 120, 187, 227, 315, 261

[56] References Cited

U.S. PATENT DOCUMENTS

| | | | |
|---|---|---|---|
| 4,639,582 | 1/1987 | Arikawa et al. . | |
| 4,718,655 | 1/1988 | Okayama et al. | 271/3.1 |
| 5,098,080 | 3/1992 | Arnone et al. | 271/187 |
| 5,169,140 | 12/1992 | Wenthe, Jr. | 271/227 X |

FOREIGN PATENT DOCUMENTS

| | | | |
|---|---|---|---|
| 0 606 721 A1 | 7/1993 | European Pat. Off. | B65H 29/40 |
| 91 16 582 | 4/1993 | Germany . | |
| 215459 | 9/1987 | Japan | 271/315 |
| 1668 | 1/1988 | Japan | 271/227 |
| 37039 | 2/1988 | Japan | 271/187 |
| 180635 | 7/1988 | Japan | 271/227 |
| 2 104 877 | 8/1982 | United Kingdom | B65H 29/40 |
| 2 122 008 | 6/1983 | United Kingdom | G07F 7/04 |
| 2 194 777 | 3/1988 | United Kingdom | B65H 29/40 |
| 2 196 323 | 4/1988 | United Kingdom . | |

*Primary Examiner*—Boris Milef
*Attorney, Agent, or Firm*—Townsend and Townsend and Crew LLP

[57] ABSTRACT

A sheet transfer member (17) has at least one outwardly opening slot (20) into which a sheet can be received. The member (17) is rotatably mounted in use so that a sheet in the slot (20) can be transferred to a sheet stacking position. A portion of the rotatable member (17) comprises high friction insert (22) which, during a dispense operation, withdraws sheets from the stacking position.

22 Claims, 7 Drawing Sheets

42
43
44
17
22
40
47
54
45
46'
46
55
50
46A
17
22
41
49
48
53
51
52
56
52'

SHEET TRANSFER MEMBER HAVING AT LEAST ONE OUTWARDLY OPENING SHEET-RECEIVING SLOT AND SHEET WITHDRAWL PORTION AND APPARATUS INCLUDING SUCH A MEMBER

FIELD OF THE INVENTION

The invention relates to a sheet transfer member and sheet dispensing and accepting apparatus, for example for use in dispensing and accepting sheets such as banknotes, cheques and other security documents.

DESCRIPTION OF THE PRIOR ART

Cash dispensing and accepting apparatus are well known as individual items either for dispensing cash to a customer or accepting cash from a customer. Combined dispensing and accepting apparatus is also known and examples are described in GB-A-2122008 and GB-A-2104877. These combined apparatus are relatively complex in construction and there is a need to reduce the complexity of such apparatus in order to reduce down time and reduce cost.

SUMMARY OF THE INVENTION

In accordance with a first aspect of the present invention, a sheet transfer member has at least one outwardly opening slot into which a sheet can be received, the member being rotatably mounted in use so that a sheet in the slot can be transferred to a sheet stacking position characterised in that a portion of the rotatable member comprises sheet withdrawal means which, during a dispense operation, withdraws sheets from the stacking position.

We have invented a much more compact sheet transfer member which can be utilised both to deliver sheets to and withdraw sheets from the stacking position. Prior art methods such as those mentioned above, require separate members to deliver sheets and to withdraw sheets.

The withdrawal means can take a variety of forms and in general can be any type of means which interacts with sheets so that they can be fed on rotation of the member. It will be possible, for example, to incorporate vacuum feed ports into the rotatable member. Preferably, however, a portion of the outer surface of the rotatable member is suitably formed to withdraw sheets which the surface engages. For example, the portion could comprise a portion having a higher coefficient of friction than the remainder of the surface, for example in the form of ribs. Preferably, the member has a body formed by a first material, the said portion being formed from a second, different material having a higher coefficient of friction than the first material.

Typically, there will be more than one suitably formed portion and in general there will also be more than one slot for receiving sheets.

Sheet transfer members according to the invention will typically be incorporated in a sheet transfer system which includes means for rotating the transfer member; and means for extracting sheets from the or each slot at the stacking position.

Typically the system further comprises a sheet store at the stacking position, the store including a sheet support surface which is movable so as to space any stack of sheets away from the rotatable member during an accept operation and to position the stack in contact with the rotatable member during a dispense operation.

Conveniently a stepper motor (or alternatively any other positional control motor) is provided for rotating the transfer member.

The sheet transfer system is particularly useful in sheet dispensing and accepting apparatus which further comprises a transport system for feeding sheets to and from the transfer system.

Typically, more than one transfer member will be provided, the members being coaxially mounted for rotation together and having aligned slots. This arrangement leads to a novel way of dealing with skew fed sheets.

Thus, in accordance with a second aspect of the present invention, sheet accepting apparatus comprises a sheet store; a sheet transport system; and a transfer device for transferring sheets from the transport system to the store, the transfer device comprising a pair of coaxially mounted rotatable transfer members according to the first aspect of the invention, the slots of the transfer members being aligned so that during an accept operation, sheets are fed into aligned slots of the members by the transport system, the transfer members rotating to deliver the sheet to the store characterised by sensing means positioned to sense whether or not a sheet is being fed to the transfer device in a skewed manner; and a motor for controlling rotation of the transfer members, the motor being responsive to the sensing means to cause the-transfer members to rotate, preferably only, when it is expected that a sheet has been fully received in all slots.

With this aspect of the invention, any sheets which have skewed during their movement by the transport system will be adjusted into a non-skewed orientation before they are delivered to the store.

It will be appreciated that the second aspect of the invention is applicable not only to sheet accepting apparatus but also to sheet dispensing and accepting apparatus such as that described above.

Another problem with the combined sheet dispensing and accepting apparatus of the prior art is the relatively large transport system which is required.

In accordance with a third aspect of the present invention, sheet dispensing and accepting apparatus comprises at least two sheet stores; a transport system for feeding sheets to and from transfer positions associated with each store; and respective transfer members at each transfer position for transferring sheets between the respective store and the transport system, and is characterised in that the transport system has a reversible section at least adjacent the transfer positions which is operated in a first direction when transporting sheets towards the transfer members and in the reverse direction when receiving sheets from the transfer members.

By providing a reversible section within the transport system, the overall bulk of the transport system can be considerably reduced.

Again, this apparatus is particularly suited in combination with apparatus according to the first and/or second and/or third aspects of the invention.

BRIEF DESCRIPTION OF THE DRAWINGS

Some examples of cash dispensing and accepting apparatus in accordance with the present invention will now be described with reference to the accompanying drawings, in which.

DETAILED DESCRIPTION OF THE EMBODIMENT

Figure 1:
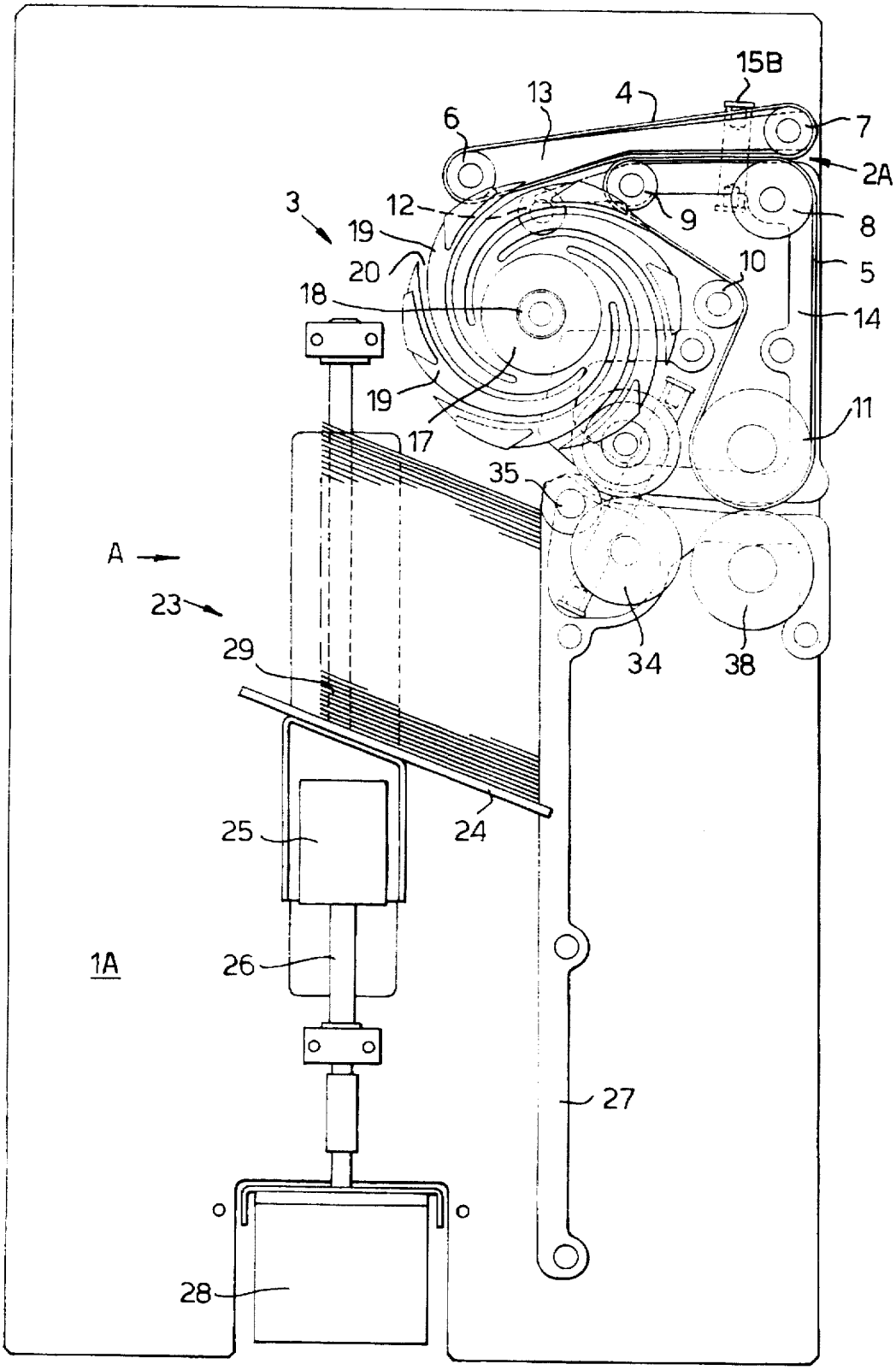
FIG. 1 is a side elevation of one example of the apparatus.
Figure 2:
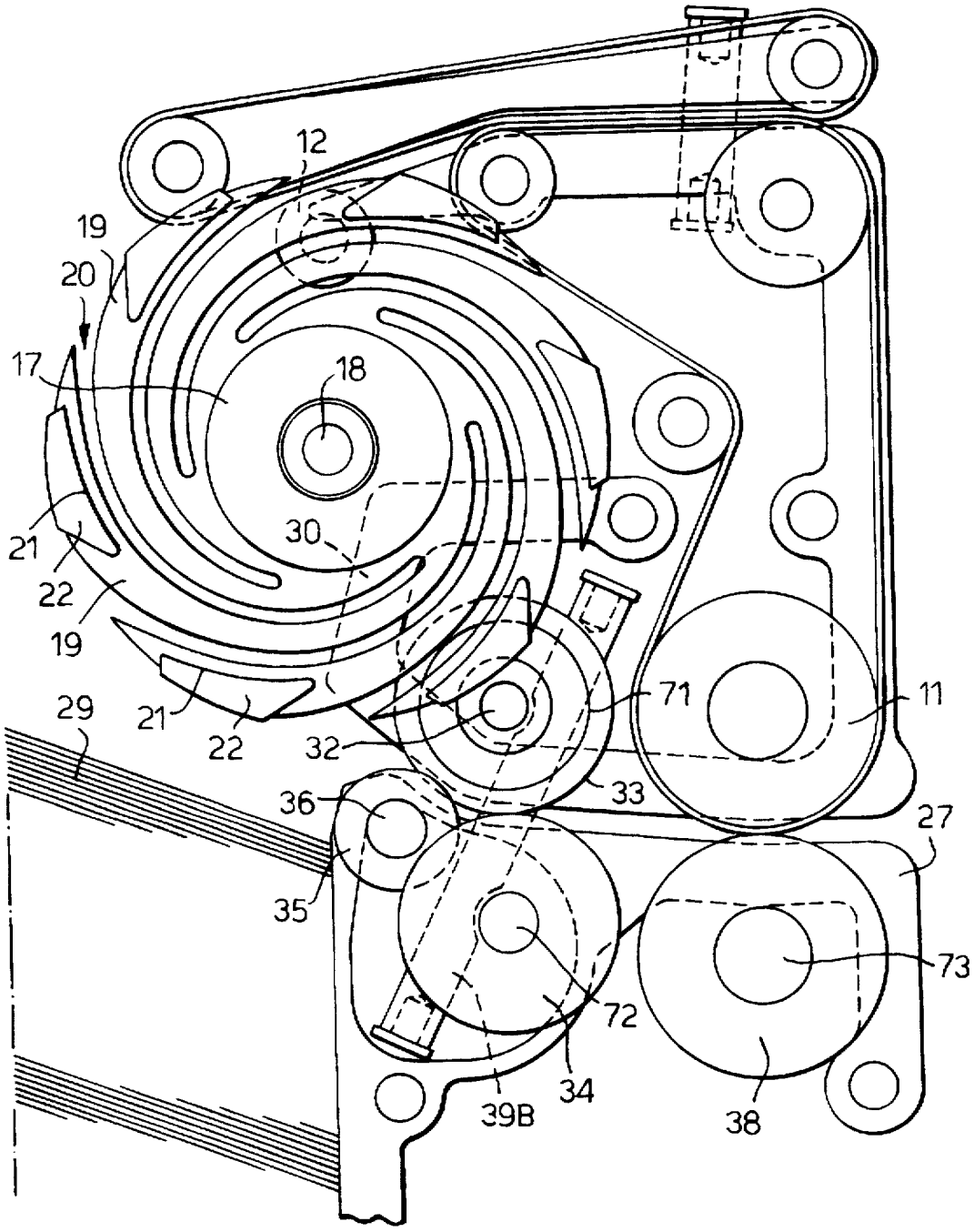
FIG. 2 is an enlarged view of part of the apparatus shown in FIG. 1.
Figure 3:
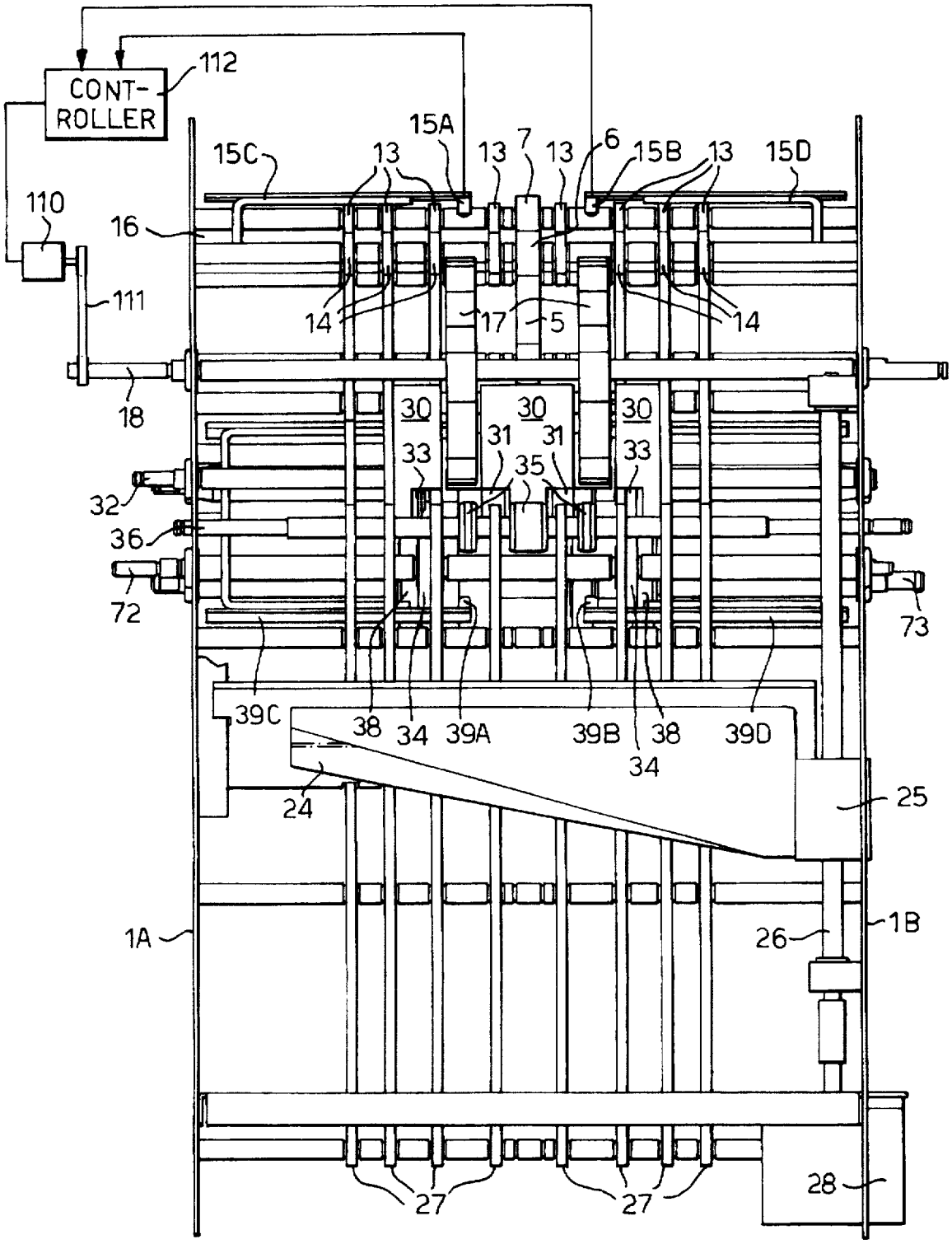
FIG. 3 is a front elevation taken in the direction A in FIG. 1.

Referring to FIGS. 1 to 3, the sheet transporting part of the apparatus is mounted between a pair of side plates 1A,1B, one of which 1A is shown in FIG. 1. Most of the drive elements (not shown) are mounted outside the side plates. A transport system transports sheets from an inlet opening 2A to a sheet store transfer position 3, the end of the transport system being defined by a cooperating pair of feed belts 4,5 entrained about rollers 6–11, and a pinch roller 12. The belt 5 is driven via the drive roller 11 which itself is driven from a motor (not shown), the belt 5 driving the belt 4 by virtue of their frictional engagement. Guides 13,14 are also provided to assist in the feeding of sheets. A pair of sensor systems 15A,15B are provided on each side of the belts 5 monitor the angular position of sheets being fed as will be described in more detail below. The sensor systems 15A, 15B are mounted to respective brackets 15C,15D supported on a strut 16 extending between the side walls 1A,1B.

Sheets are fed by the belts 5 from the inlet 2A to a pair of stacking wheels 17 defining sheet transfer members on either side of the belts 4,5 and non-rotatably mounted to a shaft 18 journalled between the side plates 1A,1B. The stacking wheels are rotated by a motor 110, such as a DC motor, coupled to the shaft 18 via a belt 111. Each stacking wheel 17 is a one-piece moulding having a set of generally radially outwardly extending tines 19 between which respective sheet receiving slots 20 are defined. One of the stacking wheels 17 can be seen in more detail in FIG. 2. Each tine 19 increases in width in cross-section as it progresses towards the outside of the wheel and an outermost section of each tine has a recess 21 in which is securely inserted a polymer segment 22 having a high coefficient of friction (relative to the material of the tines 19).

The slots 20 of the stacking wheels 17 are aligned and the wheels rotate in an anti-clockwise direction as seen in FIG. 1 to carry sheets in the slots 20 towards a sheet store 23. The store 23 is defined by an angled sheet stack support plate 24 which is mounted via a screw threaded bracket 25 to a lead screw 26. The plate 24 could be angled as shown or horizontal. Sheets are stacked on the support plate 24 with their leading edges adjacent vertical guides 27. Vertical travel of the plate 24 is caused by rotating the lead screw 26 (or other linear positioning mechanism) driven from a motor 28. The vertical position of the plate 24 is determined in accordance with the mode of operation of the apparatus (dispensing or accepting) in conjunction with sensors (not shown). Thus, when the apparatus is to accept sheets or when there are no sheets on the plate 24 or no sheets have been transported to the store, the plate is positioned so that there is a clearance between the plate 24 or the uppermost note of a stack of sheets 29 on the plate and the stacking wheels 17. When sheets are to be fed from the store 23, the plate 24 is moved so that the uppermost sheet on the stack sufficiently contacts the stacking wheel 17 so that it can be withdrawn (as will be explained below).

As the stacking wheels 17 rotate, any sheets contained within the slots 20 are stripped out by a stripper plate 30 and drop onto the support plate 24 or a stack 29 already supported on the plate 24.

Figure 7:
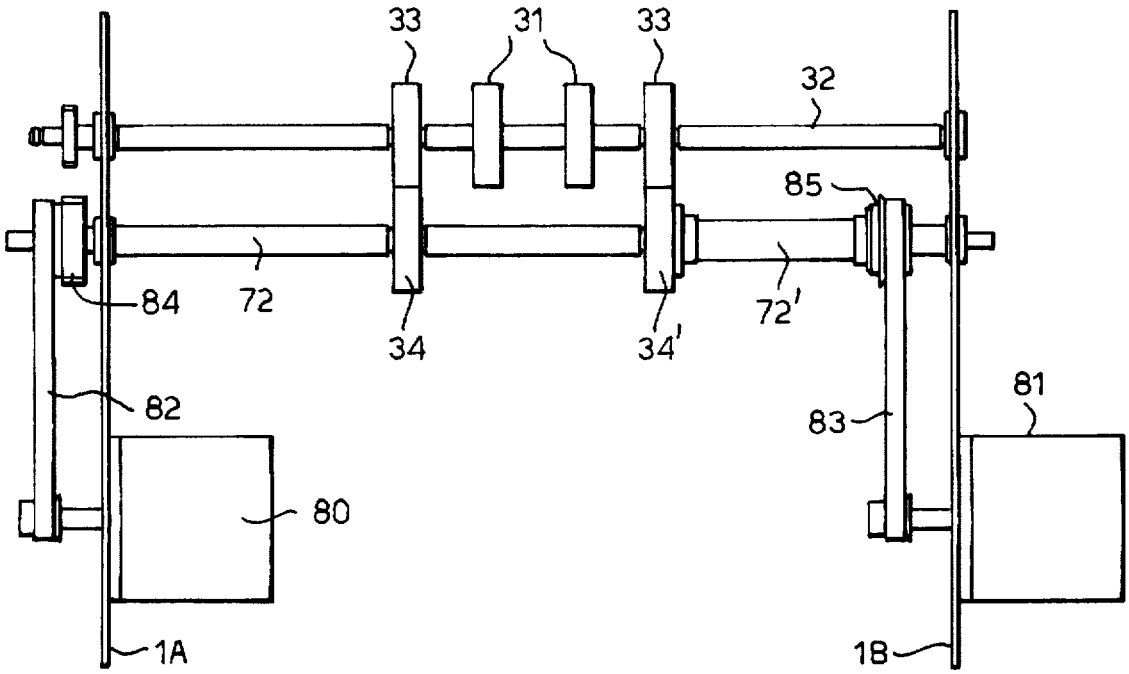

Sheets are withdrawn from the stack 29 by virtue of frictional engagement between a polymer segment 22 and the uppermost sheet on the stack while the stack is urged against the wheels 17. These sheets are fed to a pair of coaxially mounted separation rollers 31, non-rotatably mounted to a shaft 32, which is normally driven anti-clockwise through a gear system (not shown) and a one-way clutch (not shown) from the drive arrangement 110,111 used to rotate the wheels 17 (although they will also be rotated in the same direction by virtue of a sheet being pulled by the downstream transport rollers 11,38 and a pinch which exists between rollers 33,34). Rollers 33 which consist of a relatively high friction flexible material bonded to an inner sleeve 71 rotatably mounted on shaft 32 are rotated anti-clockwise by respective corresponding contacting roller 34 (rotating clockwise) non-rotatably mounted on a shaft 72 and contacting roller 34' (rotating clockwise) non-rotatably mounted on a sleeve 72' rotatably mounted on the shaft 72. Shaft 72 and sleeve 72' are each driven by separate control motors 80,81 (FIG. 7) via respective drive belts 82,83 and pulleys 84,85. Counter-feed rollers 35 non-rotatably mounted on a shaft 36 (rotatably driven anti-clockwise) prevent the withdrawal of multiple sheets simultaneously. The sheets are guided between a lower section of the guide member 14 and an upper section of a guide member 27 from which it is spaced and through the nip defined between the rollers 11 and rollers 38. Rollers 11 and rollers 38, which are non-rotatably mounted on a shaft 73, are driven at constant feed by the main transport drive system (not shown). Laterally spaced sensors 39A,39B mounted on brackets 39C, 39D are provided to detect and count the leading edge of each sheet as it is picked up by the transport system and, if sheet skew is detected, to adjust the rate of rotation of at least one of the contacting roller pairs 33,34;33,34' to substantially straighten the sheet in the transport by suitably controlling the appropriate motor 80,81 from a controller (not shown).

The sheets are then fed further from the outlet 2B through the transport system to a sheet outlet (not shown).

The operation of the apparatus shown in FIGS. 1 to 3 will now be described in more detail.

In a sheet accept operation, sheets are fed by the transport system from the inlet to the point 2A defined at the entrance to the belts 4,5. The belt 5 and hence the belt 4 is driven at a uniform speed that matches the upstream transport speed before the point 2A. At this stage, the stacking wheels 17 are stationary and are located as shown in the drawings with a pair of slots 20 aligned to receive incoming sheets. The support plate 24 is also positioned so that a clearance exists between the plate or the uppermost sheet of a stack on the plate and the stacking wheels 17. A control system 112 indicates that a sheet stacking sequence is to commence. The first sheet to be stacked is fed by the belts 4,5 into the slots 20. If the sensor system 15A,15B indicates that the leading edge of the sheet is skewed, the control system 112 allows the feed operation to continue for more than a normal feed time to ensure that the sheet is fully fed into the aligned slots 20 of the stacking wheels 17. Once a sheet has fully entered the slots 20, the motor connected to the shaft 18 is actuated (or a clutch is actuated) and the stacking wheels 17 rotate in an anti-clockwise direction until the next slot 20 is aligned with the belts 4,5 so as to receive the next sheet. This process continues until the control system recognises that the final sheet of the batch to be stacked has entered the stacking wheels 17.

As the stacking wheels 17 rotate, each sheet is brought into alignment with the store 23 and its leading edge will engage the stripper plate 30 so that on further rotation of the stacking wheels 17 the sheet is stripped from the stacking wheels and drops onto the stack 29. When the system notes that a final sheet has arrived, it causes the stacking wheels 17 to continue to rotate until that final sheet has been stripped. During this process, the plate 24 is lowered to maintain a clearance between the top of the stack 29 and the stacking wheels 17.

In a dispense operation, initially the plate 24 is raised until the uppermost sheet of the stack 29 engages the stacking wheels 17 with sufficient force. The motor is then actuated to cause the stacking wheels 17 to rotate in an anti-clockwise direction and the segments 22 engaging the uppermost sheet of the stack 29 will urge that sheet under friction towards the rollers 33,34,34'. Counter-feed rollers 35 resist the feeding of more than one sheet from the stack. The sensors 39A,39B register each sheet as it is fed and rotation of the stacking wheels 17 continues until completion of the dispense cycle. If the sensors 39A,39B detect a leading edge of a sheet at different times this indicates the sheet is being skew fed and the rate of rotation of at least one of the roller pairs 33,34;33,34' can then be adjusted to straighten the sheet. As more sheets are fed from the store 23, the plate 24 is raised to maintain contact between the uppermost sheet and the stacking wheels 17. The transport system then transports the withdrawn sheets to a sheet outlet.

Various modifications of the system described are possible. For example, the rollers 11,38 could define a sheet thickness detector.

The transport systems could be formed by pairs of belts, pairs of rollers or vacuum feed devices in a conventional manner.

Different methods have been described for dealing with skew fed sheets on the input and output sides. It is, of course, possible, if more than one pair of belts 4,5 is provided, for the different pairs of belts 4,5 to be driven at different speeds to correct for skew.

The separation rollers 31 could be driven independently rather than through a one-way clutch device from the drive to the stacking wheels 17.

In the example described above, the stripper plate 30 is fixed in position. In the examples shown in FIGS. 4 and 5, a pivoted stripper plate is illustrated. Otherwise, the general construction of the assembly is the same.

Figure 4:
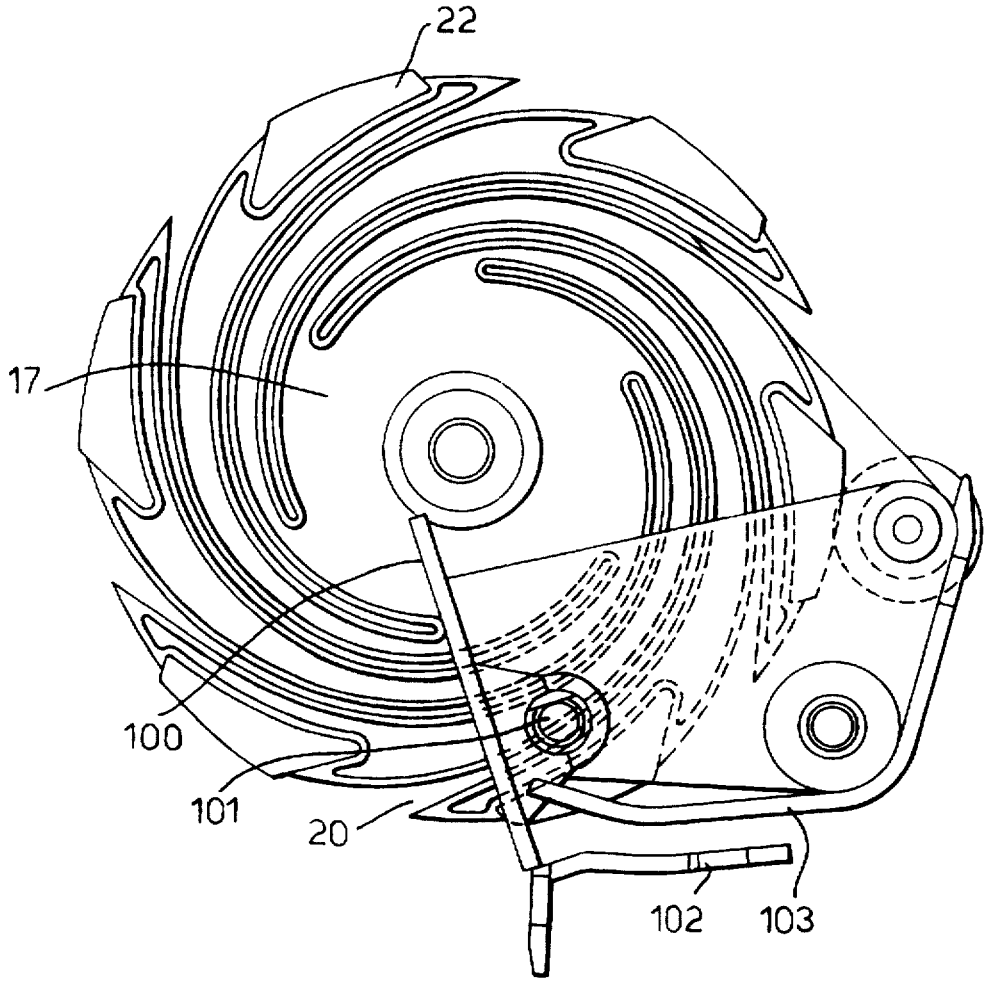
FIG. 4 is a view similar to part of FIG. 2 but showing a second example in a stripping position.
Figure 5:
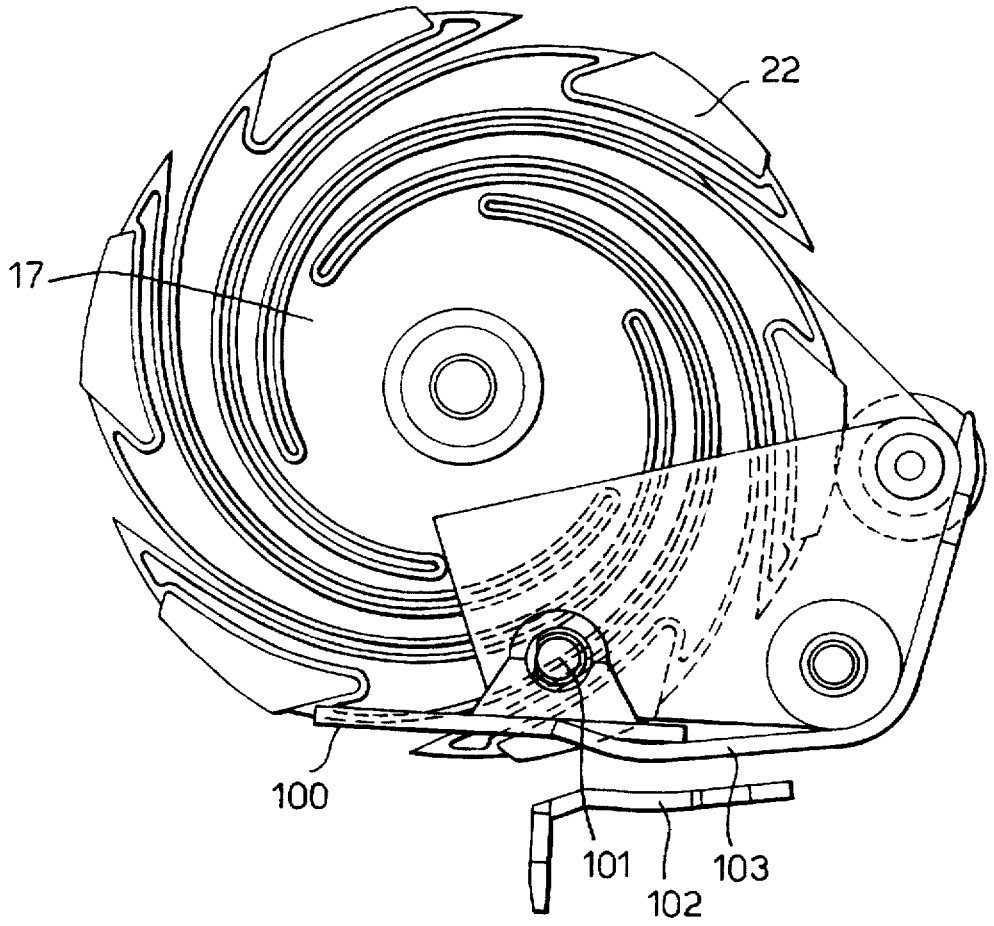
FIG. 5 is a view similar to FIG. 4 but in a withdrawal position.

In this case, instead of a fixed stripper plate, a stripper plate 100 is provided fixed to a shaft 101 extending between the side plates 1A,1B for movement between a stripping position shown in FIG. 4 and a withdrawal position shown in FIG. 5. The position of the stripper plate can be controlled by controlling the shaft 101 in a conventional manner from outside the side plates. In the stripping position shown in FIG. 4, sheets will be stripped from the slots 20 as in the previous example and dropped onto the stack 29. The stripper plate 100 prevents any stacked sheets from inadvertently being fed through into the withdrawal system whose entrance is defined between guide plates 102,103.

During a withdrawal operation, the stripper plate 100 is pivoted to the position shown in FIG. 5 and assists in guiding sheets into the entrance to the withdrawal path between the guide plates 102,103.

Figure 6:
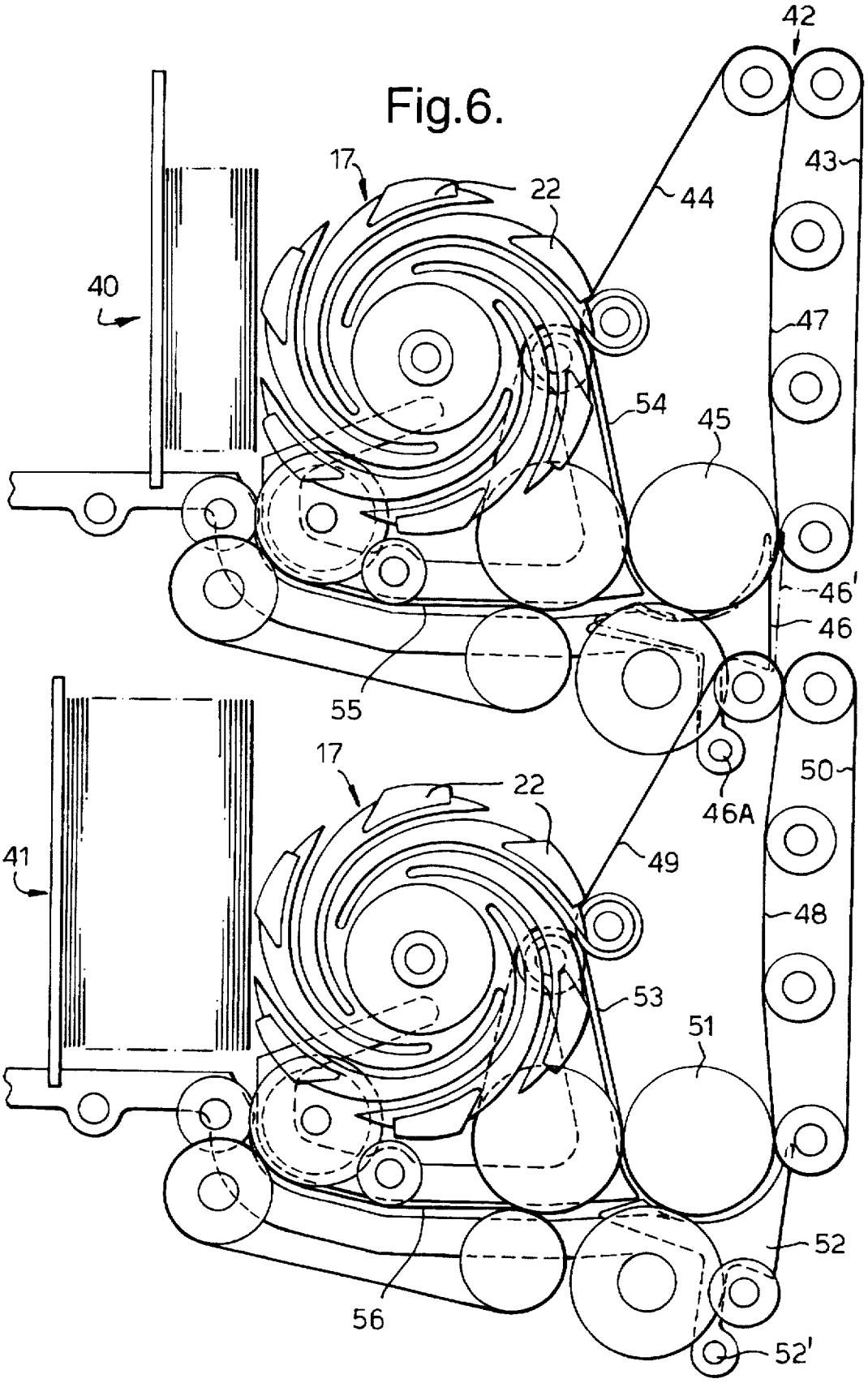
FIG. 6 is a side elevation of a third example of apparatus having multiple stores; and, FIG. 7 illustrates part of the apparatus of FIGS. 1 to 3 with several parts omitted for clarity.

In the examples described, separate transport systems could be provided for conveying sheets to and from that part of the apparatus shown in FIGS. 1 to 5. However, it is particularly convenient if a common transport system is utilized and such a system is partially shown in FIG. 6. In this example, two sheet stores 40,41 are shown, each having a construction similar to the sheet store 23. Sheets are fed to and withdrawn from the sheet store using pairs of stacking wheels 17 similar to those described above. These aspects of the apparatus shown in FIG. 6 will not therefore be described in detail. Sheets being fed into the apparatus during an accept operation are fed to a position 42 defining the entrance to a feed path defined by pairs of belts 43,44. The belt 44 is driven by a drive roller 45 from a motor (not shown), the belt 44 frictionally driving the belt 43. A diverter 46 pivoted at 46A is positioned at the other end of the path 47 defined by the belts 43,44 and in the position shown allows sheets to pass on to a second feed path 48 defined between pairs of belts 49,50 (only one pair shown in FIG. 6). The belts 49 are driven by a roller 51 connected to a drive motor (not shown) and the belts 49 frictionally drive the belts 50.

In an accept operation, the control system first decides into which store 40,41 an incoming sheet is to be stored. In the situation shown in FIG. 6, an incoming sheet is to be stored in the store 41 so that the diverter 46 is positioned by the control system to allow sheets to pass from the path 47 to the path 48 while a diverter 52 pivoted at 52' is activated to guide sheets into an input path 53 from where they enter slots in the stacking wheels 17, as before. After a sheet or batch of sheets has been supplied, the diverters 46,52 are deactivated. In this case the diverter 46 is already in its passive or deactivated position while the diverter 52 moves to its deactivated position (not shown) corresponding to that of the diverter 46. If the incoming sheet is to be fed to the store 40, then the diverter 46 is moved to its activated position 46' and the sheet is fed via the diverter 46 into a path 54 and from there into the slots in the stacking wheels 14.

In a dispense operation, both diverters 46,52 are deactivated and the respective one of the support plates in the stores 40,41 is activated to cause the corresponding stack to engage the stacking wheels 17. The uppermost sheet is then withdrawn and fed along a path 55 or 56 where it will engage the respective diverter 46,52. In the deactivated state, the diverters are free to pivot under the influence of the sheet so that the diverter is progressively rotated by the sheet to assume the position (shown for example at 46' in FIG. 6) at which the sheet is guided into the respective path 47 or 48. In addition, during a dispense operation, the belts 43,44,49,50 are moved in the opposite or reverse direction so that dispensed sheets are fed back to the position 42 and from there on through the transport system to the outlet.

We claim:

1. A sheet transfer member having at least one outwardly opening slot into which a sheet can be received, the member being rotatably mounted so that a sheet in said slot can be transferred to a sheet stacking position, wherein a portion of said member comprises sheet withdrawal means which, during a dispense operation, withdraws sheets from said stacking position.

2. A member according to claim 1, wherein said sheet withdrawal means comprises a portion of the outer surface of said member which is suitably formed to withdraw sheets which the surface engages.

3. A member according to claim 2, wherein said portion has a high coefficient of friction relative to other portions of the outer surface of said member.

4. A member according to claim 3, wherein the member has a body formed by a first material, said portion being formed from a second, different material having a higher coefficient of friction than said first material.

5. A member according to claim 4, wherein said body of said member is formed as one piece.

6. A member according to claim 2, said member having at least two of said portions.

7. A member according to claim 1, the member having at least two of said slots.

8. A member according to claim 7, said member having at least two of said portions, and wherein each slot has an associated portion which is suitably formed to withdraw sheets.

9. A sheet transfer system for transferring sheets to and from a sheet stacking position, the system comprising:

a sheet transfer member according to claim 1;

means for rotating said sheet transfer member; and means for extracting sheets from the at least one slot at the stacking position.

10. A sheet transfer system according to claim 9, further comprising a sheet store at said stacking position, said store including a sheet support surface which is movable so as to space any stack of sheets away from said sheet transfer member during an accept operation and to position said stack in contact with said sheet transfer member during a dispense operation.

11. A sheet transfer system according to claim 9, comprising a motor for rotating said sheet transfer member.

12. A sheet transfer system according to claim 9, comprising a plurality of said sheet transfer members, said sheet transfer members being coaxially mounted for rotation together and having aligned slots.

13. A sheet transfer system according to claim 9, wherein said extracting means comprises a stripper member which is engaged by a sheet during movement of said sheet transfer member to strip said sheet from said slot.

14. A sheet transfer system according to claim 13, wherein said stripper member is movable between a stripping position and a non-stripping position.

15. A sheet dispensing and accepting apparatus comprising:

a sheet transfer system according to claim 10; and a transport system for feeding sheets to and from said sheet transfer system.

16. Apparatus according to claim 15, wherein said sheet transport system feeds sheets from and to a common inlet/outlet.

17. A sheet accepting apparatus comprising:

a sheet store;

a sheet transport system;

a transfer device for transferring sheets from said transport system to the store, the transfer device comprising a pair of coaxially mounted rotatable transfer members, each transfer member having at least one outwardly opening slot into which a sheet can be received, each transfer member being rotatably mounted so that a sheet in a respective one of said slots can be transferred to a sheet stacking position, wherein a portion of each transfer member comprises sheet withdrawal means which, during a dispense operation, withdraws sheets from said stacking position, the slots of said transfer members being aligned so that during an accept operation, sheets are fed into aligned slots of the transfer members by the transport system, said transfer members rotating to deliver the sheet to the store, and sensing means positioned to sense whether or not a sheet is being fed to said transfer device in a skewed manner; and a motor for controlling rotation of said transfer members, said motor being responsive to the sensing means to cause the transfer members to rotate when a sheet has been fully received in all slots.

18. Apparatus according to claim 17, wherein the motor is responsive to the sensing means to cause the transfer members to rotate only when a sheet has been fully received in all slots.

19. A sheet dispensing apparatus comprising:

a sheet store;

a sheet transport system comprising two laterally spaced pairs of feed members;

a transfer device for transferring sheets from said store to said transport system, said transfer device comprising at least one rotatably mounted sheet transfer member, the transfer member having at least one outwardly opening slot into which a sheet can be received, the transfer member being rotatably mounted so that a sheet in said slot can be transferred to a sheet stacking position, wherein a portion of said transfer member comprises sheet withdrawal means which, during a dispense operation, withdraws sheets from said stacking position, whereby rotation of said transfer member withdraws sheets from said store and feeds them to said transport system, and sensing means positioned to sense whether or not a sheet is being fed from said transfer device in a skewed manner; and means for controlling operation of said two pairs of feed members independently so as to correct any sensed sheet skew.

20. Sheet dispensing and accepting apparatus comprising:

at least two sheet stores;

a transport system for feeding sheets to and from transfer positions associated with each store; and respective transfer members at each transfer position for transferring sheets between the respective store and said transport system, each transfer member having at least one outwardly opening slot into which a sheet can be received, each transfer member being rotatably mounted so that a sheet in a respective one of said slots can be transferred to a sheet stacking position, wherein a portion of each transfer member comprises sheet withdrawal means which, during a dispense operation, withdraws sheets from said stacking position;

wherein the transport system has a reversible section at least adjacent said transfer positions which is operated in a first direction when transporting sheets towards the transfer members and in the reverse direction when receiving sheets from the transfer members.

21. A sheet transfer member having a plurality of outwardly opening slots into which a sheet can be received, the sheet transfer member being rotatably mounted so that a sheet in a given one of said slots can be transferred to a sheet stacking position, wherein each slot of said sheet transfer member has an associated portion which is suitably formed to withdraw sheets from said stacking position during a dispense operation.

22. A sheet transfer member having a body made of a first material and formed with a plurality of outwardly opening slots into which a sheet can be received, the sheet transfer member being rotatably mounted so that a sheet in a given one of said slots can be transferred to a sheet stacking position, wherein each slot of said sheet transfer member has an associated portion, made of a second, different material having a higher coefficient of friction than said first material, which portion is suitably formed to withdraw sheets from said stacking position during a dispense operation.

* * * * *